United States Patent [19]

Platzer et al.

[11] Patent Number: 4,944,502

[45] Date of Patent: Jul. 31, 1990

[54] CARD WEBBER

[75] Inventors: Kurt Platzer, Friedberg; Herwig Hirschek, Bobingen; Edwin Schaller, Langweid; Helmut Holzinger, Augsburg, all of Fed. Rep. of Germany

[73] Assignee: Autefa Maschinenfabrik GmbH, Friedberg, Fed. Rep. of Germany

[21] Appl. No.: 270,542

[22] Filed: Nov. 14, 1988

[30] Foreign Application Priority Data

Nov. 10, 1987 [DE] Fed. Rep. of Germany ..... 3738190

[51] Int. Cl.[5] ..... B65H 29/46

[52] U.S. Cl. ..... 270/31; 270/39; 493/410; 493/423; 493/937

[58] Field of Search ..... 270/30, 31, 39; 493/410, 422, 423, 441, 937; 226/108, 113, 114, 118, 119; 19/163

[56] References Cited

U.S. PATENT DOCUMENTS

| | | | |
|---|---|---|---|
| 3,558,029 | 1/1971 | Manns | 19/163 |
| 3,638,279 | 2/1972 | Swados | 19/163 |
| 4,194,270 | 3/1980 | Hille | 19/163 |
| 4,357,739 | 11/1982 | Hille | 19/163 |

FOREIGN PATENT DOCUMENTS

| | | | |
|---|---|---|---|
| 2542274 | 1/1977 | Fed. Rep. of Germany | 19/163 |
| 60-43450 | 9/1985 | Japan | 19/163 |
| 61-757772 | 4/1986 | Japan | 270/31 |
| 929028 | 6/1963 | United Kingdom | 19/163 |

*Primary Examiner*—Robert E. Garrett
*Assistant Examiner*—Therese M. Newholm
*Attorney, Agent, or Firm*—McGlew & Tuttle

[57] ABSTRACT

A card webber is disclosed including two rotating conveyor belts carried by deflection rollers and two folding carriages movable between a first position and a second position. Variable velocity actuators are provided, a first velocity actuator associated with the belts and a second velocity actuator associated with the reversibly movable carriages. The velocity actuators are settable such that the velocity of the belts and the velocity of the folding carriages may be adjusted at different velocities with the velocity of the belts being different from the velocity of the carriages.

10 Claims, 3 Drawing Sheets

CARD WEBBER

FIELD OF THE INVENTION

The invention relates to a card webber comprising at least two rotating conveyor belts and at least two reversibly moved folding carriages which are accelerated at the reversal points of their paths.

BACKGROUND OF THE INVENTION

Various versions of such card webbers are known, e.g. from DE-OS 24 29 106. These devices serve to plait a card web in several layers on top of each other while forming a fleece. The card web is produced in an upstream carder and processed further in a machine following the webber, e.g. in a needle punching machine. In the needle punching machine the fleece is compressed and densified, thus creating a so-called needle felt.

In the card webber or in the machines preceding it or following it mistakes may occur during the processing for physical or mechanical reasons, which may result in inhomogeneities in the fleece or in the finished end product. Physical problems, e.g. occur in the card webber in which the card web is continuously moved over the conveyor belts while the two folding carriages execute a reversible movement over a limited section and in addition they have to slow down and then accelerate again at the reversal points of their paths. This results in material accumulation at the material edges. DE-OS 24 29 106 tries to solve this problem by means of complicated kinematics of the movement of the folding carriages relative to one another, connected with a synchronized controlling means of the webber. Herein an internal intermediate storage is formed via an auxiliary carriage which is filled and emptied to homogenize the folding movement. Due to the high effort and expenditure required for the construction of this device, however, it did not catch on in practice. It does not offer a solution for processing inhomogeneities and the influence of other machines.

SUMMARY AND OBJECTS OF THE INVENTION

It is the objective of the present invention to provide a simple, practical and operationally safe solution resulting in a homogeneous end product.

Advantageously the invention provides for a card webber with at least two rotating conveyor belts and with at least two reversibly moved folding carriages which reciprocate between a first and second position and which are accelerated at the reversal points of their paths. The relationship between the velocity of the belt conveyor V and the velocity of the folding carriages V, between the acceleration phases is not fixed. Instead each velocity may be adjusted relative to one other.

Normally the conveyor belt velocity and the velocity of the folding carriages are substantially equal with the drive for each being interdependent or linked with the exception of the acceleration phases. That is the conveyor belt normally moves along at substantially the same speed as the folding carriages until the carriages reach their reversal point. According to the invention, linkage and velocity equality are eliminated and a difference in the velocities is consciously created. This results in variations of the thickness of the folded card web. When the folding carriage moves slower than the conveyor belt, the folded card web will be thicker, it will be thinner when the carriage is faster as the card web is elastic and may be crushed and stretched.

According to the invention this effect can be varied and used for various purposes. The difference in velocity can be kept continuous and constant. This leads to the regular increase or decrease in the thickness of the card web mentioned above. An increase in the thickness of the card web is e.g. advantageous with regard to the natural shrinkage of the folded card web. In order to secure the transport of the card web it is stretched a little and kept under tension in the card webber. Some of the tension subsides only after the card web is already folded. This leads to undesirable locked-up tension, which can be counteracted by consciously increasing the thickness of the card web. A thinner card web, which can be advantageous for other purposes and card web materials, can be achieved by means of a conscious increase in tension due to faster moving folding carriages.

The differences in velocity may exist only over a part of the path and may also differ in magnitude. This allows for the elimination of a disadvantageous accumulation of material at the edges of the fleece by acceleration of the carriages at the reversal points over the normal acceleration phase to a velocity which is higher than the velocity of the conveyor belt. Hereby shrinkage-tensions are created at the edges. The increase in the velocity difference can be lessened after a short while to receive a regularly folded fleece. Further applications for the manipulation of the card web thickness according to the invention are the correction of existing inhomogeneities and/or the prevention of later processing mistakes. An upstream carder e.g. can produce an irregular card web thickness. In this case an oppositely directed manipulation of the card web thickness can compensate.

A downstream needle punching machine e.g. may work irregularly over the width of the ribbon. Here a prophylactic compensation can be achieved by oppositely directed manipulation of the card web.

According to the invention the difference in velocity can be achieved by manipulating the absolute velocity of the conveyor belts and/or the folding carriages. At the reversal movement of the carriages, it is necessary to vary their velocity and to keep the velocity of the conveyor belt constant. Executions can vary. A simple way to vary the velocity is to install separate actuators for the carriages and the conveyor belt, one or both actuators being equipped with freely programmable controlling means. It is also possible, however, to work with a common central actuator and to change the final velocity of the folding carriages and of the conveyor belts by means of continuously or incrementally controllable gears e.g.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENTS

Figure 1:
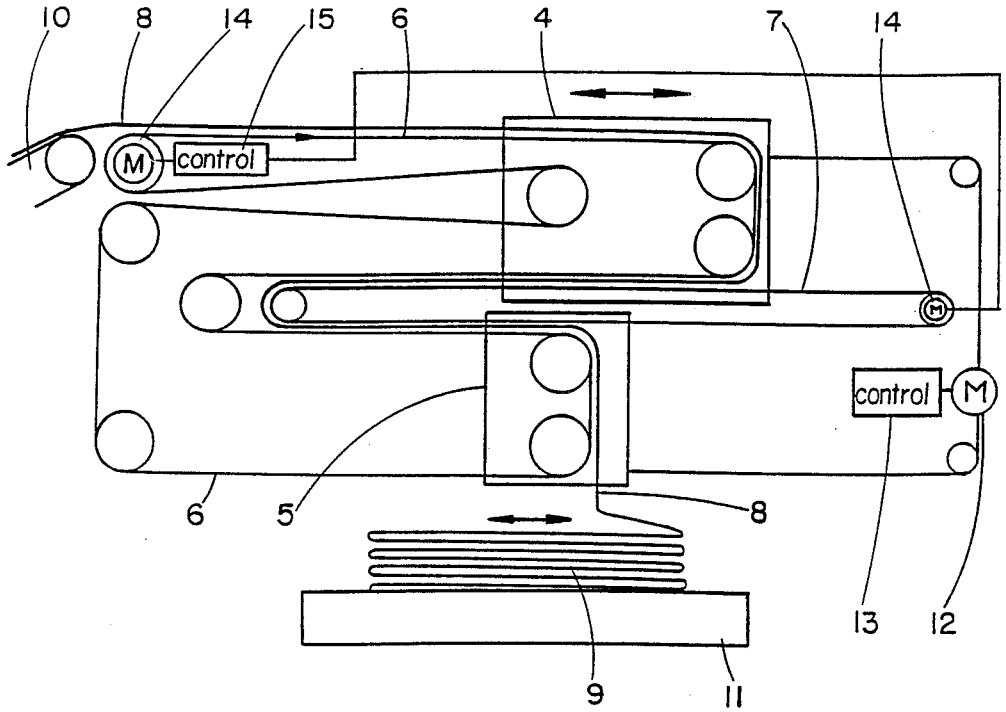
FIG. 1 is a schematic drawing of a card webber in an embodiment as a conveyor belt depositor with interweaving conveyor belts.

Referring to the drawings, in particular, the inventive card webber includes two rotating conveyor belts. The conveyor belt 6 being associated with two reversibly movable folding carriages 4 and 5. The apparatus advantageously includes a belt actuator means 14 for driving the first belt 6 and the second belt 7 and second actuator means 12 for independently driving the first folding carriage 4 and the second folding carriage 5 independently of the driven belts 6 and 7.

Figure 2:
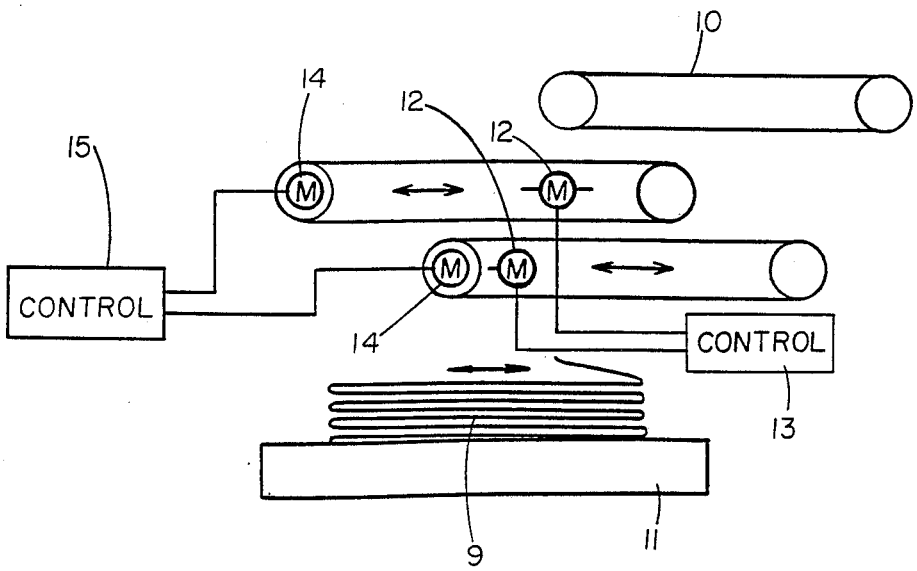
FIG. 2 shows a card webber in an embodiment as a carriage depositor with separate conveyor belts for each carriage.

FIG. 1 and 2 show two different embodiments of a card web webber 1, each having a card web fed continually from an upstream carder not shown via a transition belt 10. Via the card webber 1 the web 8 is folded on the delivery belt 11 in several layers in order to form a fleece. In both designs the card webber 1 comprises a lower folding carriage 5 which deposits the card web in a reversing movement, and an upper folding carriage reversing in the opposite direction. The card web 8 is moved on its way through the card webber by two endless conveyor belts 6, 7.

FIG. 1 shows a so-called conveyor belt depositor 2, in which one of the conveyor belts 6 is led over the two carriages 4, 5 in a multiple-layered loop. The second conveyor belt 7 is positioned inside a loop of the conveyor belt 6 formed by the two carriages 4, 5. The deflection rollers for the conveyor belt 6 arranged on the carriages 4, 5 are moved with the reversing movement of the two carriages 4, 5 in opposite direction while the other deflection rollers are stationary. The continuously fed card web 8 moves via the carriage 4 into the transport opening between the two conveyor belts 6, 7 and onto belt 7 which moves in the same direction as belt 6 in this section. The card web moves through a loop onto the depositor carriage 5 which moves it forward and backward over the fleece 9 and deposits it there. The delivery belt 11 slowly moves forward the fleece 9 made from layers of card web.

The two folding carriages 4, 5 are connected through a common actuator and move at their own velocity each in opposite directions. Herein the carriage 4 moves with half the velocity of carriage 5 and goes half as far as carriage 5. The actuator 12 is a servo-actuator connected to a freely programmable controlling means 13. Therefore the velocity of the carriages 4, 5 can be changed to any desires setting, the acceleration phases in the reversal points of the movement can also be changed as desired. In the embodiment shown the two conveyor belts 6, 7 have separate actuators 14, preferably servo-actuators, too, which are fed by a common control means 15 and which are moved at the same velocity. In order to transport the card web 8 fed in from outside at a constant velocity, the belt actuator 14, 15 runs constantly, giving the conveyor belt 6 the conveyor velocity V, which can be the same as the transport velocity of the transition belt 10. Various variations of the shown example are possible. The carriages 4, 5 may have separate actuators. The carriage velocity V can be kept constant and the conveyor belt velocity V can be changed, herein additional measures, such as an upstream storage etc., allow for respective changes in the feeding velocity of the card web 8.

FIG. 2 show a so-called carriage depositor 3, whose two folding carriages 4, 5 have their own endless conveyor belt 6, 7. Here, too, the carriage actuators 12 can be shared or separated. They are connected with a freely programmable controlling means 13. The same is true for the conveyor belt actuators 14. In both embodiments at least the actuators requiring adjustable velocity are equipped with a freely programmable controlling means. The constant actuators do not need them, but may be equipped with them.

In all embodiments servo-actuators, in particular rpm-regulated actuators are provided for the folding carriage actuator 12, the conveyor belt actuators 14 and the actuator for the delivery belt 11. The servo-actuators have a highly dynamic motor behavior, so that the actuators can be adjusted exactly in the pars pro mille range and therefore the card web thickness can be adjusted in the percent range. The servo-actuators can have various designs and comprise e.g. rotary current motors with frequency converter and speedometer control.

An optimal embodiment also comprises on-line feeding of the selected set values for all positions of movement of the axes connected to the servo actuators.. Thus the set values of $V_c$ and $V_b$ for the control of the thickness of the various card web layers depending on the card web feeding velocity of the upstream machine. Herein the relationship between resp. the velocity profile of $V_c$ and $V_b$ remains constant. The adjustment of the velocity of the delivery belt 11 takes place in the same way so that the card web layers are arranged exact in position and number.

A correlated velocity regulation for the three axes of the card webber i.e. carriages 4, 5, conveyor belts 6, 7 and delivery belt 11 is advisable in order to change the velocity without impairing the relationship.

The technical execution of the control of the changes in velocity via the path of the folding carriages is best effected via a microprocessor control. The microprocessor includes prepared data records stored for any possible case. By this arrangement, the user can change these set values according to his requirements. Several data records are stored in a parallel manner, so that the user of the plant can chose the correct operational data for the respective product via choice of menu.

Ideally the data records only represent the velocity profile, not the actually driven velocity. The velocities can change during operation and are calculated on-line by the microprocessor on the basis of the velocity profiles and the actual card web feeding velocity.

Figure 3:
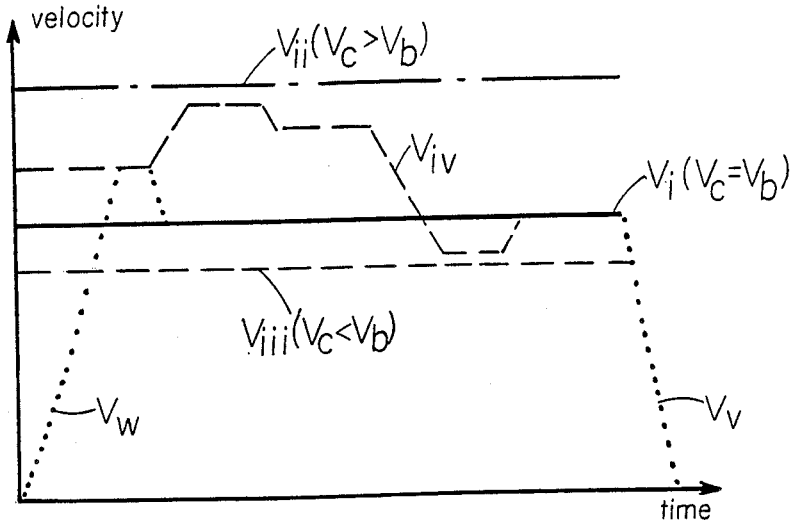
FIG. 3 is a diagram of the velocity conditions with regard to time.
Figure 4:
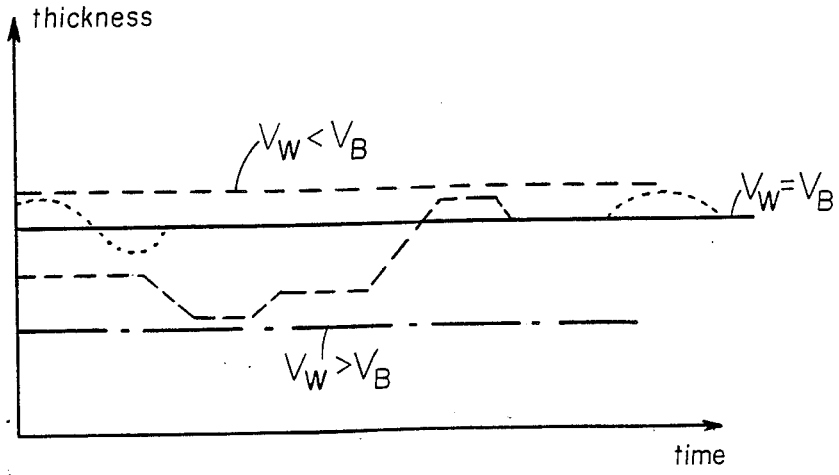
FIG. 4 is a diagram of the changes in the card web thickness over time in relation to FIG. 3.

FIG. 3 shows five different settings of the folding carriage velocity $V_c$ and the velocity of the conveyor belt $V_b$. FIG. 4 shows the resulting thickness of the upper card web, which has just been put down, in addition. The relationship between the FIGS. 3 and 4 is shown by corresponding line patterns.

FIG. 3 shows five different sets of the relationship between carriage velocity and conveyor belt velocity. Both diagrams are based on a constant velocity of the conveyor belt. In both diagrams the unbroken line is a reference line. In FIG. 3, the reference line represents the velocity of the conveyor belt $V_b$ and at the same time one of the variations (a first variation $V_i$), wherein the velocity of the conveyor belt $V_b$ corresponds to the velocity of the folding carriages $V_c$.

For reasons of simplicity the acceleration phases for the carriage velocity at the reversal points have been omitted. These acceleration phases may have different shapes, depending on the kind of control and they may be linear or, according to DE-OS 24 29 106, a trigonometric function.

The upper horizontal characteristic $V_{ii}$, marked dash-dot-dash, is a second variation. Herein the carriage velocity is higher than the conveyor belt velocity. According to FIG. 4 this results in a thinner card web. The deposit carriage 5 moves faster with relation to the fleece 9 than the card web 8 is moved downwards by the conveyor belts 6, 7. The deposited card web 9 is stretched and becomes thinner.

The third variation $V_{ii}$ is marked by short dashes in FIG. 3 and represents a constant carriage velocity over the path with the exception of the acceleration phase which is lower than the velocity of the conveyor belt $V_c$. Herein the conveyor belts 6, 7 transport more card web than can be deposited because of the slower carriage movement 5. Therefore in FIG. 4, the card web is thicker than the reference thickness.

The fourth variation $V_{iv}$ consists in a velocity difference changing with position and time between $V_c$ and $V_b$. The difference may be constant or, as in the example, change in magnitude over place and time. Herein the carriage velocity can be changed in steps or gradually, according to the changes in thickness desired and according to the kind of controlling means used. In contrast to the velocity profile of $V_c$, the card web thickness is constantly thinner than normal at first, then it becomes suddenly thinner, subsequently it increases and becomes stronger than normal from the point where the carriage velocity $V_c$ becomes smaller than the conveyor belt velocity $V_b$. The changes shown in the thickness of the card web can e.g. preclude irregularities produced by a following needle punching machine, if it densifies e.g. only a little at the right edge of the fleece and stronger again in the middle area. The irregularities produced by the needle punching machine would correspond to the characteristic $V_c$ in FIG. 3.

Depending on degree and place of the desired manipulation of the card web thickness the velocity characteristics can be used forward and backward. Thus the deposit of the card web is manipulated in the same way when the deposit carriage moves forward or backward. However, it is also possible to preset different characteristics for the first and second directions. E.g. the first direction follows the step-shaped characteristic and the deposit carriage 5 moves at a constant velocity corresponding to the velocity of the conveyor belt $V_b$ in the second direction.

A special fifth possibility $V_v$ is shown as a dotted line in FIG. 3 and 4. It relates to the balancing of the accumulations at the edges of the fleece 9 due to the slowing down and acceleration processes of the deposit carriage 5 in the reversal points. $V_c$ is here lower than the constant $V_b$ and as a result the card web is partially thicker. To compensate, the velocity of the folding carriages $V_c$ is increased over the conveyor belts velocity $V_b$ after the reversal point, then kept constant for a while and then reduced back to $V_b$, as shown in FIG. 3. FIG. 4 shows at the left edge how the accumulation at the edge changes over into a thinning of the card web and then into a normal thickness of the card web. Due to the longer path of the deposit carriage 5 the deposited card web has enough time to decrease the inner tension created artificially in the card web, thus additionally supporting the natural shrinkage process. In the execution shown the deposit carriage 5 is slowed down to 0 at the end of its path, resulting in the accumulation at the right edge. As a variation to this the deposit carriage 5 could also be accelerated shortly before the reversal point for the purpose of thinning the card web. On the way back not shown the deposit carriage 5 is accelerated over the velocity of the conveyor belt $V_b$ in the same way as in the first direction. This way the accumulation on both sides is compensated for.

The relative velocity of conveyor belts and folding carriages counts most in manipulating the card web. In variation to the shown executions the conveyor belt velocity can therefore also change according to a preset function via the time or the velocity, e.g. in a sine function according to DE-OS 24 29 106.

In the diagrams 3, 4 no numerical values are given for the actual absolute velocities and differences. They depend to a large extend on the card web material used and can vary accordingly. It is advisable, however, to chose the differences only in a magnitude to keep the created tensions in the card web within the natural elasticity of the material. In the thickening of the card web the differences are kept so small that the deposited card web does not pucker or plait down. This refers to normal usage. In special cases deviations from the teachings can be made.

What is claimed is:

1. A card webber including at least two rotating conveyor belts and including two reversibly movable folding carriages which are accelerated at the reversal points of their paths, wherein a drive for the conveyor belts and a drive for the folding carriages include independent actuators and the velocity of the belt conveyor and the velocity of the folding carriages between the acceleration phases may be adjusted at different velocities relative to one another said actuators each being servo-actuators, at least one of said actuators having a fully programmable controlling means.

2. A card webber according to claim 1, wherein: the difference between the velocity of the belt $V_b$, and the velocity of the folding carriages $V_c$ is constant.

3. A card webber according to claim 1, wherein: the difference between the velocity of the folding carriages $V_c$, and the velocity of the belt conveyor $V_b$ is either variable or constant in different sections of the paths of the folding carriages.

4. A card webber according to claim 1, wherein: the folding carriage velocity $V_c$ is variable and the velocity of the conveyor belt $V_b$ is constant.

5. A card webber comprising: a first folding carriage movable between a first position and a second position and a second folding carriage movable between a first position and a second position, a first endless belt carried by at least two deflection rollers; a second endless belt carried by at least two deflection rollers; belt actuator means operatively connected to said first endless belt and said second endless belt for establishing the speed of the first and second endless belt, the speed being variable; and, folding carriage actuator means operatively connected to said first folding carriage and said second folding carriage for establishing the speed of the folding carriages, the speed being variable independently of the speed of the first and second endless belts, each said actuator means including at least one servo actuator and at least one programmable control means setting the speed of said at least one servo actuator.

6. A card webber according to claim 5, wherein: said at least two deflection rollers carrying the first endless belt are each carried by one of said first and second folding carriages, said at least two deflection rollers carrying said second endless belt being fixed.

7. A card webber according to claim 5, wherein: said at least two deflection rollers carrying said first endless belt are carried by said first folding carriage and said at least two deflection rollers carrying said second endless belt are carried by said second folding carriage.

8. A card webber according to claim 5, wherein: said belt actuator means and said carriage actuator means are each settable such that the difference between the velocity of said carriages and that of said belts is constant.

9. A card webber according to claim 5, wherein: said belt actuator means and said carriage actuator means are each settable such that the difference between the velocity of said carriages and the velocity of said belts is both variable and constant depending upon the position of said folding carriages.

10. A card webber according to claim 5, wherein: said folding carriage actuator is settable such that the velocity of the folding carries varies in dependence upon the position of the folding carriages and the belt actuator means is settable such that the velocity of the conveyor belts is constant.

* * * * *